US007323682B2

(12) United States Patent
McCauley et al.

(10) Patent No.: US 7,323,682 B2
(45) Date of Patent: Jan. 29, 2008

(54) PULSED ION SOURCE FOR QUADRUPOLE MASS SPECTROMETER AND METHOD

(75) Inventors: Edward B. McCauley, Cedar Park, TX (US); Scott T. Quarmby, Round Rock, TX (US); George B. Guckenberger, Austin, TX (US)

(73) Assignee: Thermo Finnigan LLC, San Jose, CA (US)

( * ) Notice: Subject to any disclaimer, the term of this patent is extended or adjusted under 35 U.S.C. 154(b) by 296 days.

(21) Appl. No.: 11/081,339

(22) Filed: Mar. 15, 2005

(65) Prior Publication Data

US 2006/0016978 A1 Jan. 26, 2006

Related U.S. Application Data

(63) Continuation-in-part of application No. 11/021,219, filed on Dec. 23, 2004, now abandoned.

(60) Provisional application No. 60/585,056, filed on Jul. 2, 2004.

(51) Int. Cl.
*H01J 49/00* (2006.01)

(52) U.S. Cl. ..... 250/287; 250/286; 250/287; 250/288; 250/292; 250/396 R

(58) Field of Classification Search ..... 250/288, 250/286, 287, 295, 396 R, 281–283
See application file for complete search history.

(56) References Cited

U.S. PATENT DOCUMENTS

| | | | |
|---|---|---|---|
| 3,787,681 | A | 1/1974 | Brunnee et al. |
| 5,756,996 | A | 5/1998 | Bier et al. |
| 6,294,780 | B1 | 9/2001 | Wells et al. |
| 6,573,496 | B2 | 6/2003 | Harada |
| 2005/0194543 | A1 | 9/2005 | Hieke |

FOREIGN PATENT DOCUMENTS

| | | | |
|---|---|---|---|
| EP | 0905743 | A1 | 3/1999 |
| WO | WO0077824 | A1 * | 12/2000 |

* cited by examiner

*Primary Examiner*—Jack I. Berman
*Assistant Examiner*—Michael J Logie
(74) *Attorney, Agent, or Firm*—Fish & Richardson P.C.; Sharon Upham

(57) ABSTRACT

A variable duty cycle ion source assembly is coupled to a continuous beam mass spectrometer. The duty cycle can be adjusted based on previous scan data or real time sampling of ion intensities during mass analysis. This provides the ability to control the total number of ions formed, mass analyzed and detected for each ion mass of interest. The frequency of the ion source can be sufficiently high (kHz range) so as to maintain accurate peak centroiding. The ion source assembly can be used for both electron ionization (EI) or chemical ionization (CI) modes of operation.

33 Claims, 9 Drawing Sheets

PULSED ION SOURCE FOR QUADRUPOLE MASS SPECTROMETER AND METHOD

CROSS-REFERENCE TO RELATED APPLICATIONS

This application is a continuation-in-part of U.S. Ser. No. 11/021,219, filed Dec. 23, 2004 now abandoned, which claims priority to U.S. Provisional Application Ser. No. 60/585,056, filed Jul. 2, 2004, which applications are incorporated by reference herein in their entirety.

TECHNICAL FIELD

This invention relates to methods and apparati for mass spectrometry.

BACKGROUND

Combined gas chromatography mass spectrometry (GC/MS) is a well established analytical technique. Typically, injection volumes of a few microliters into the inlet of a gas chromatograph are analyzed from extracted samples. Since routine detection levels are on the order of one picogram, the total range in analyte concentrations delivered to an ion source can vary by $>10^9$. Since the dynamic range of modem instruments are several orders lower than this, premature electron multiplier failure, source sensitivity loss and quadrupole contamination can occur due to excessive sample loading. Historically, pre-screening of sample extracts utilizing a flame ionization detector or other means have been used to determine appropriate dilution factors. Dilution of sample extracts can bring concentrated analytes within the working range of the mass spectrometer as well as serve to protect it from premature degradation of sensitivity, resolution and tune. While this method is effective in providing longer service intervals for GC/MS instrumentation, it suffers from imposing a reduced sensitivity for all components of interest even during "clean" areas of a chromatogram. In addition, this requires extending the degree of sample handling and preparation.

Referring to FIG. 1, a typical prior art quadrupole mass spectrometer is illustrated. A filament 17 powered by filament supply 20 emits electrons which are accelerated toward a grounded ion volume 11. Since the filament is biased by a voltage source 19, electrons gain kinetic energy as they travel toward the ion volume and subsequently ionize a portion of sample molecules existing within the confines of the ion volume. These ions are extracted and focused in a continuous manner by a set of lens elements 14, 15, and 16 and are drawn into a quadrupole mass filter 10 which is biased at a suitable potential to give a predetermined ion energy. RF and DC potentials applied to the rods of the mass filter allow for selective mass transmission to a suitable detector 12. In this prior art method, electrons are emitted continuously by the filament 17 and can be measured by a sensor 18. This information can be fed to the filament supply 20 to control the filament temperature and thereby provide current regulation based on total emission current. This prior art method employs the use of a continuous beam ion source coupled to a continuous beam mass analyzer in which electrons flow continuously into an ion volume.

Referring to FIG. 2, a typical ion trap mass spectrometer is illustrated. In this type of mass analyzer, a non continuous beam ion source 32 is coupled to a non continuous beam mass analyzer defined by a single ring electrode 30 and a pair of endcap electrodes 31. A filament 38 powered by filament supply 41 emits electrons which are accelerated toward a grounded ion volume 32. Since the filament is biased by a voltage source 40, electrons gain kinetic energy as they travel toward the ion volume and subsequently ionize a portion of sample molecules within the ion volume. In these devices, it is necessary to introduce ions into a trapping field prior to mass analysis. The formation of ions or their injection into the trapping field must be done in an inject then scan fashion consistent with this batch mode of mass analysis. These ions are extracted from the ion source and focused in a non-continuous pulsed mode into the trap, by applying an extraction waveform to a gate electrode 36. Pulsed ion beams have been required in ion trapping devices due to the non-continuous nature of mass analysis. Though pulsing of the ion beam resolves the requirement for inject then scan, it has been found that excessive neutral noise from metastable helium atoms results if the filament emits electrons into the ion volume during the scan out of ions. For this reason, it is generally desired to reduce the electron energy below that required for metastable atom formation, or to stop the electron current into the ion volume entirely when mass analysis occurs. This problem has been addressed as described in U.S. Pat. No. 5,756,996 and in a modified version in U.S. Pat. No. 6,294,780. Operation of ion trap mass spectrometers is described in U.S. Pat. Nos. 4,540,884 and 4,736,101.

One disadvantage of ion trapping devices is that they suffer from space charge limitations of the number of ions which can be stored in the trap. Consequently, it is necessary to alter the ion injection time or ion formation time using automatic gain control (AGC), in order to reduce the population of ions in the trap and prevent these space charge saturation effects from occurring. It has been noted on these devices that since the total number of ions delivered to the mass analyzer and subsequently the detector are limited, that increased multiplier lifetime and analyzer cleanliness are maintained. It has also been observed that switching off the electron flow into the ion volume completely during non-injection as described in Wells et al. (U.S. Pat. No. 6,294,780), or by reducing the electron energy to a level which gives poor ionization efficiencies during non-injection as in Bier et al. (U.S. Pat. No. 5,756,996) also helps to keep ionizer components clean.

While AGC can be used in ion trapping devices to control total ion populations within the trap, doing so reduces their abundances in equal proportions. This has the deleterious effect of precluding detection of small abundance ions in the presence of large ion currents.

SUMMARY

In view of the foregoing, what is desired is a technique for protecting a mass spectrometer against excessive sample loading without sacrificing detection limits. As will be seen, this invention provides a means for doing so which is particularly suitable for a continuous beam instrument such as a quadrupole or magnetic sector analyzer. Additionally, several other advantages are realized, including extension of dynamic range, which could be used on a non-beam instrument such as an ion trap or time of flight instrument as well.

This invention relates to an ion source assembly for a beam mass spectrometer and to a method of operation, and more particularly to an ion source in which the total number of ions produced during a given scan is controlled based on previously acquired scans within the analysis, or in a real time fashion as ions of a particular mass to charge ratio are detected.

In general, a variable duty cycle ion source assembly is coupled to a continuous beam mass spectrometer. The duty cycle can be adjusted based on previous scan data or real time sampling of ion intensities during mass analysis. This provides the ability to control the total number of ions formed and detected for any given mass during mass analysis. Note that the term mass is used here and throughout this application as an abbreviation for mass to charge ratio (m/e). In GC/MS, almost all ions are singly charged so the mass is equal to the mass to charge ratio.

The frequency of the ion pulses is sufficiently high (kHz range) so as to maintain accurate peak centroiding. In particular, the pulsed ionization source can have a frequency greater than 1 cycles/Dalton, e.g., greater than 5 cycles/Dalton, such as 10-50 cycles/Dalton.

Consequently, the present invention can effectively mimic a varied dilution of chromatographic effluent streams based on a predetermined maximum number of ions to be generated in a given retention window(s). In particular, this method allows ion abundance control on a mass-to-mass basis using a continuous beam device.

In one aspect, the invention is directed to a mass spectrometer that has an ion volume to receive atoms or molecules of a sample, an electron source to inject electrons into the ion volume to ionize the atoms or molecules in the ion volume, a mass filter having a mass scanning rate, and an electron gate for gating electrons at a frequency equal to or greater than the mass scanning rate and having a variable duty cycle. Mass scanning rate is defined as the mass peak width divided by the time spent at that mass peak. For example, a typical mass scanning rate for a unit resolution quadrupole mass analyzer can be 1 Da/ms with a mass peak width of 1 Da at the base. In situations where one does not scan across the entire mass peak, no mass peaks are produced. This is often the case for selected ion monitoring (SIM) mode. The mass peak width is not defined since there is no peak. In this case, the mass scanning rate is one over the time spent observing that mass, say 1/200 ms or 5 Hz.

In another aspect, the invention is directed to a mass spectrometer that has an ion volume to receive atoms or molecules of a sample, an electron source for injecting electrons into the ion volume to ionize the atoms or molecules in the ion volume, a mass filter having a mass scanning rate, and an ion extractor to transfer the ionized atoms and molecules from the ion volume to the mass filter. The ion extractor includes a gate which gates ions at a frequency equal to or greater than the mass scanning rate and having a variable duty cycle.

In another aspect, the invention is directed to an ion trap mass spectrometer that has an ion volume to receive atoms or molecules of a sample, an electron source for injecting electrons into the ion volume to ionize the atoms or molecules in the ion volume, an electron gate to control passage of electrons from the electron source to the ion volume, a mass filter, and an ion gate to control passage of ions from the ion volume to the mass filter. The electron gate operates at a first frequency and having a variable duty cycle, and the ion gate operates at a second frequency that is lower than the first frequency.

In yet another aspect, the invention is directed to an ion trap mass spectrometer that has an ion volume to receive atoms or molecules of a sample, an electron source for injecting electrons into the ion volume to ionize the atoms or molecules in the ion volume, an electron gate to control passage of electrons from the electron source to the ion volume, and an ion trap to receive ions from the ion volume. The electron gate has a variable duty cycle and configured to control the number of ions in the ion volume, and the number of ions received by the ion trap is controlled primarily by the electron gate.

In yet another aspect, the invention is directed to a time-of-flight mass spectrometer that has an ion volume to receive atoms or molecules of a sample, an electron source for injecting electrons into the ion volume to ionize the atoms or molecules in the ion volume, an electron gate to control passage of electrons from the electron source to the ion volume, and a time of flight analyzer to receive ions from the ion volume. The electron gate has a variable duty cycle and configured to control the number of ions in the ion volume.

In still another aspect, the invention is directed to a hybrid time-of-flight mass spectrometer that has an ion volume to receive atoms or molecules of a sample, an electron source for injecting electrons into the ion volume to ionize the atoms or molecules in the ion volume, an electron gate to control passage of electrons from the electron source to the ion volume, one of a mass filter or an ion trap, and a time-of-flight analyzer to receive ions from the one of the mass filter or the ion trap. The electron gate has a variable duty cycle and configured to control a number of ions in the ion volume.

Implementations of these inventions may include one or more of the following features. The electron source may include a filament and a voltage source for applying a voltage to the filament. The voltage with respect to the source may be sufficient to accelerate the electrons to an energy sufficient to ionize atoms and molecules. The electron gate may be variable between a plurality of different fixed duty cycles, or may have a continuously variable duty cycle, e.g., adjustable from 0-100% duty cycle. The electron gate may have a frequency greater than 1 cycle per Dalton scanned by the mass filter, e.g., greater than 5 cycles/Dalton, such as 10-50 cycles/Dalton. The duty cycle of the electron gate may be varied throughout a mass filter scan, or varied during valleys between adjacent ion masses. The atoms and molecules may be ionized directly, or the electrons may ionize reagent gas molecules or atoms to form ions which in turn ionize the sample molecules or atoms. The electron gate may be a lens using an electric field, a grid using an electric field, or a deflection plate using an electric field, or the electron gate may include an electromagnet to generate a magnetic field. The duty cycle of the electron gate may be adjusted before a scan or during a scan. The duty cycle of the electron gate may be adjusted based on the previous scan, such as based on a total ion current from a previous scan or based on ion currents associated with specific masses of a previous scan. The duty cycle of the electron gate may be adjusted during the scan based on ion current feedback within the same scan. The mass filter may be a quadrupole mass analyzer, a magnetic sector mass analyzer, or an ion trap analyzer. An ion extractor may transfer the ionized atoms and molecules from the ion volume to the mass filter. The extractor may include a plurality of lenses. The electron gate may be the electron source, or the electron gate may be separate from the electron source and may control a flow of electrons from the electron source to the ion volume. Implementations of the invention may include one or more of the following features. The mass filter may be an ion trap mass spectrometer.

Potential advantages of the invention can include one or more (or none) of the following.

The ion source assembly can be used for both electron ionization (EI) or chemical ionization (CI) modes of operation.

Controlling ion abundances can preserve detection limits while also increasing dynamic range by multiple orders of magnitude. In fact, the linear dynamic range of a continuous beam mass spectrometer can be extended 100 fold or more.

Spectrometer cleanliness can be maintained for extended periods of time since ion abundances can be limited to intensities which are statistically valid and yet low enough to preclude premature contamination. The detrimental effects due to excessive sample loading can be reduced.

The pulsed ionization source can have an off period shorter than the formation time of reagent gas plasma ions in CI mode thus ensuring that the plasma is not completely extinguished during the "off" time of the filament.

The relative abundances of ion ratios can be adjusted by modulation of the electron gate duty cycle during a mass scan. Ion abundance can be controlled on an individual mass-to-mass basis. Analyte detection capability can be increased or maximized consistent with a maximum predefined total ion current.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Ions can be produced within an ion source through the interaction of energetic electrons with gas phase molecules or atoms in the electron ionization mode (EI) or by interaction with primary reagent gas ions in the chemical ionization mode (CI). The maximum number of ions produced is controlled by varying the duty cycle of an electron beam. The control can be based on a previous mass resolved scan, non mass resolved pre-scan or in real time during the detection of discrete ion masses. The duty cycle can be based on the ratio of the "on" time to the duration of the "off" time over a specified time period. In particular, the duty cycle of the electron beam can be altered by using a fixed frequency and varying the pulse width, or it can use a fixed pulse width and vary the frequency. Or, both frequency and pulse width can be varied. The duty cycle can be varied utilizing duty cycle variation parameters, including, but not limited to, time, frequency, intensity, phase and number of pulses.

The current invention employs a variable duty cycle ion source coupled to a continuous beam mass analyzer in which ions are pulsed at a repetition rate which equals or exceeds the spectral scan rate. Since linear continuous beam quadrupole mass analyzers are not subject to the space charge limitations or sequencing of ions into a trapping field, and since ion control can be accomplished on a mass-to-mass basis during mass analysis, a pulsed ion source coupled to a quadrupole affords a much larger degree of ion abundance control than prior art methods. In addition, the frequency of ion pulses is not limited to the scan rate of the mass analysis, and can be tailored for optimum performance.

Figure 3A:
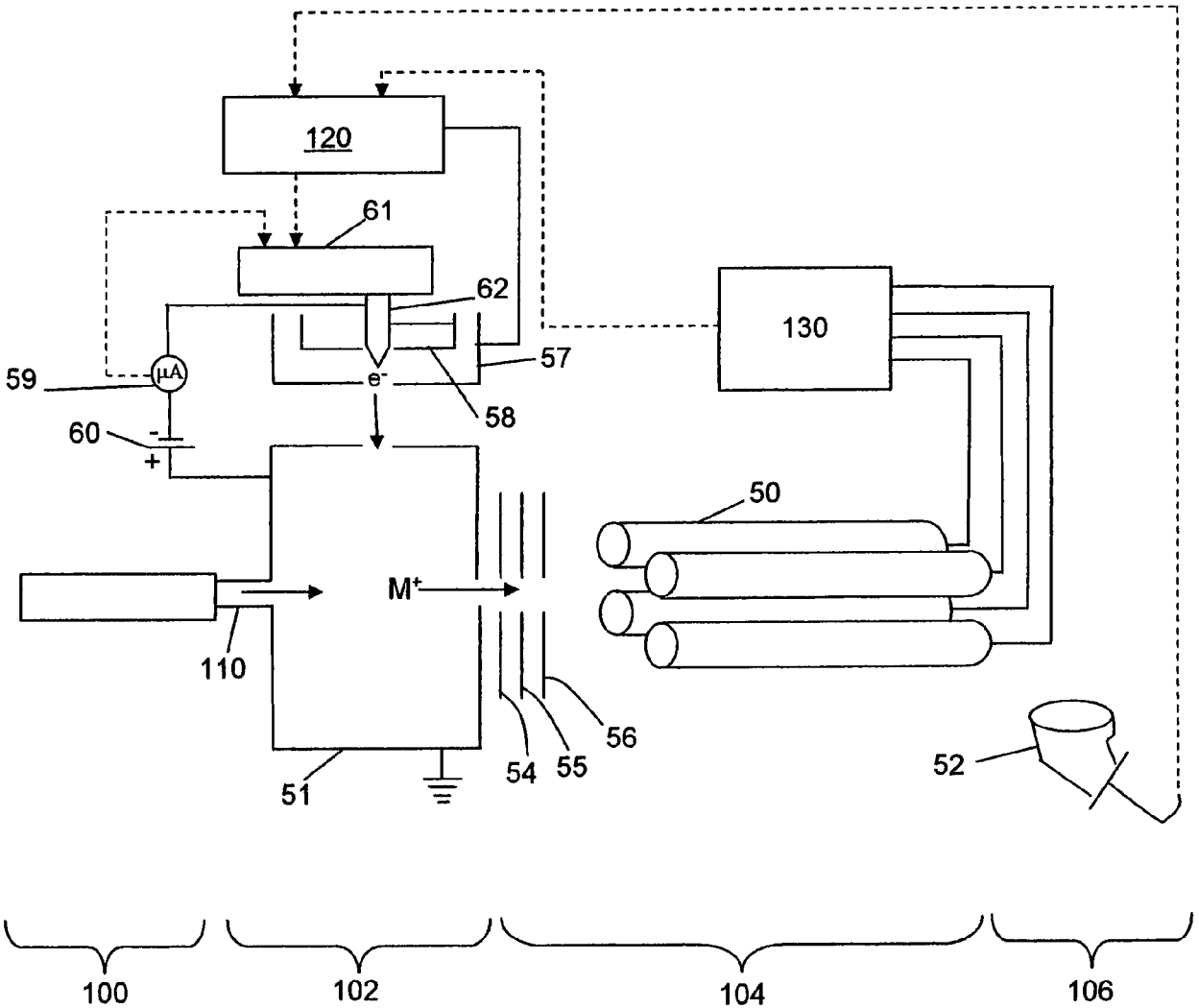
FIG. 3A is a schematic illustration of an implementation of a mass spectrometer constructed according to the present invention.

Referring to FIG. 3A, a GC/MS system includes a source 100, such as a gas chromatograph, of sample particles, such as atoms or molecules. The mass spectrometer includes an ion source 102 to ionize the sample molecules, a mass filter 104, such as a quadrupole mass filter or an ion trap, for example, to separate the ions from the ion source 102 based on their mass-to-charge ratio, and a detector 106 to detect the ions separated by the mass filter 104.

The sample molecules from the gas chromatograph 100 can be carried through a passage or orifice 110 into an ion volume 51 of the ion source 102 by a carrier gas, such as helium. It should be noted that the ion volume could be any region where atoms or molecules are ionized. For example, the ion volume could be a typical external ion source as indicated in FIG. 3A or it could be an ion trap or a quadrupole, octopole, or other multipole.

An electron source such as a filament 62 powered by a filament supply 61 is biased by a voltage source 60. The filament 62 emits electrons which pass through a gate 57 as they are accelerated toward the grounded ion volume 51. It should be noted that any electron source could be used such as an electron field emitter or cold cathode, or electron generator array. The voltage source 60 can also be coupled to a reflector 58 so that the reflector 58 and the filament 62 are at the same potential in order to provide a uniform electric field between the filament and gate.

Assuming that the gate 57 is "open", the electrons gain kinetic energy as they travel toward the ion volume and subsequently ionize a portion of sample molecules existing within the confines of the ion volume 51. However, if the gate 57 is "closed", then the electrons are blocked from entering the ion volume and ions are not produced. A controller 120 applies a waveform with a variable duty cycle to the gate 57 in order to control passage of electrons into the ion volume, and thereby control the time periods during which ions are created. The waveform can vary the duty cycle by either varying the pulse width of the waveform, whilst maintaining a constant frequency, or by keeping the pulse width constant and varying the number of pulses provided. Or, both pulse width and frequency can be varied. The operation of the controller 120 will be discussed in greater detail below.

Ions generated in the ion volume 51 are extracted and focused in a continuous manner by a set of lens elements 54, 55, and 56 and are drawn into the rods 50 of the quadrupole mass filter 104. A voltage source 130 applies radio frequency (RF) and DC potentials to the rods of the mass filter to allow for selective mass transmission to the detector 106, which can include an electron multiplier 52, an amplifier, and a means of converting this analog signal to a digital signal. In operation, the voltage source 130 typically scans the amplitude of the voltage applied to the rods 50 across a preset range, thereby scanning the mass passed by the quadrupole mass filter through a preset range. There can be multiple scans during a single sample peak from the gas chromatograph. For example, a gas chromatograph may generate a peak over a period of about three seconds. If a quadrupole mass filter has a scan frequency of two Hz (e.g., if the mass filter has a scan rate of 1000 Daltons/second and scans over a range 500 Daltons wide, then the mass filter has a scan frequency of about two scans per second), it can generate about six scans across the chromatographic peak.

Information regarding the voltage source 130, such as the frequency and DC offset of the scan signal, can be directed to the controller 120. This permits the controller 120 to adjust the duty cycle based on the mass currently being transmitted by the quadrupole mass filter 50. In addition, the signal from the detector 106 can be directed to the controller 120. This permits the controller to dynamically adjust the duty cycle based on the sensed ion current. Other ion optical, ion filtering, or ion transmission elements may exist between the ion source and the mass analyzer.

The current emitted from the filament 62 can be measured by a sensor 59, and this information can be fed to the filament supply 61 to control the filament temperature and provide current regulation. However, the filament control circuit 61 also receives the gating waveform from the controller 120. Thus, the filament control circuit 61 can be configured to sample the sensor measurements only during an "on" portion of the waveform. The sampling can be done either repetitively during a pulsed scan, continuously during the analytical mass scan or during an interval before or after the analytical mass scan. The sampled emission current is then used to set the filament current.

Figure 3B:
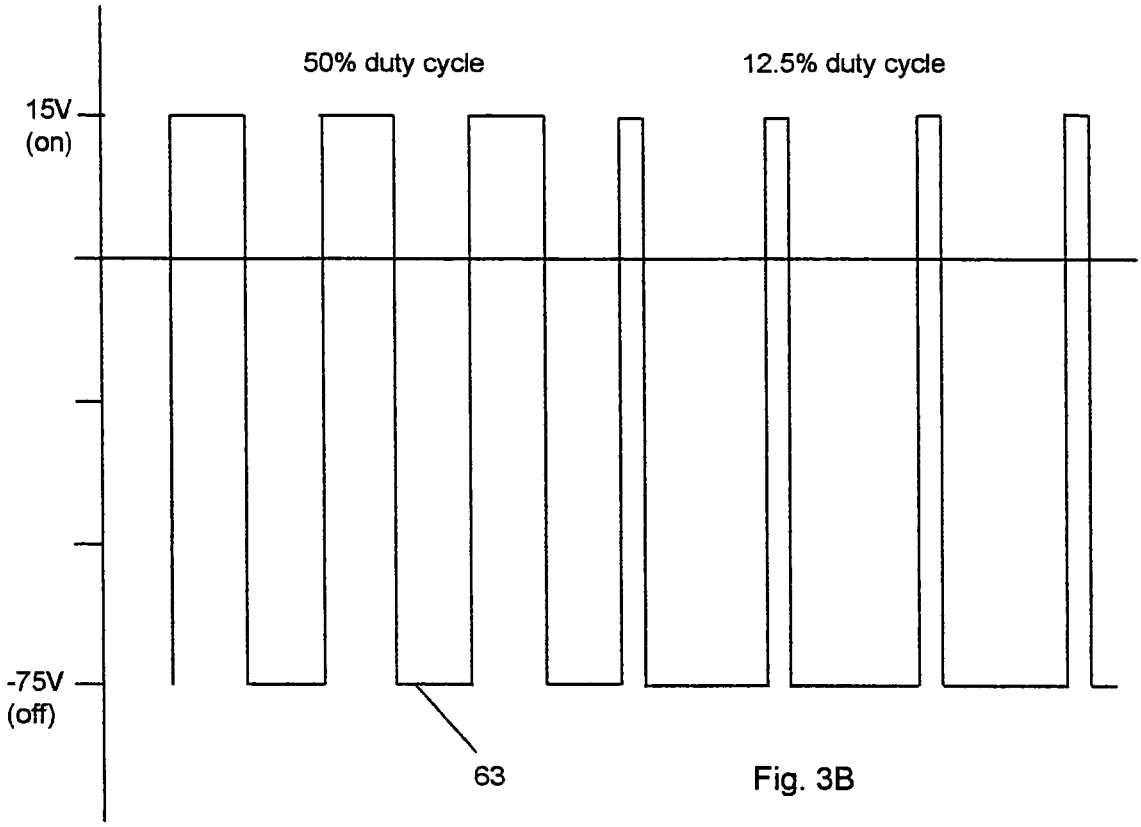
FIG. 3B is a schematic illustration of a gate lens waveform.

Returning now to the ion source 102, as described above, the ion volume 51 receives gated electron bursts from the filament 62, and the gating of these electrons is controlled by an electron gate 57 which receives a pulsed waveform 63 (see FIG. 3B) with a variable duty cycle. It is desirable that the frequency of pulsation gives 10-50 cycles per Dalton and is variable from 0.1 to 100% duty cycle (duty cycles of 50% and 12.5% are illustrated in FIG. 3B). The frequency of oscillation can be varied consistent with the desired scan rate of the quadrupole mass filter in order to achieve the desired 10-50 cycles per Dalton. Since the mass analyzer is of the continuous beam type, it is possible and desirable to program the electron gate duty cycle with the scan to also allow for adjustment of relative abundance ratios of ions.

Figure 4A:
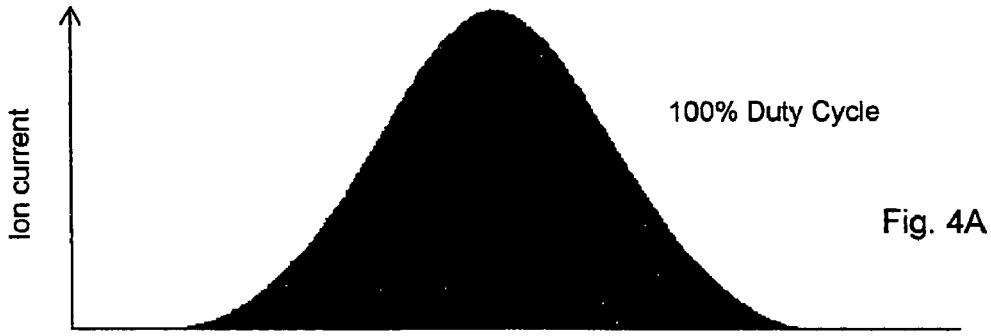
FIGS. 4A-4C are graphs illustrating hypothetical ion current as a function of time at a particular mass peak for three different duty cycles.
Figure 4B:
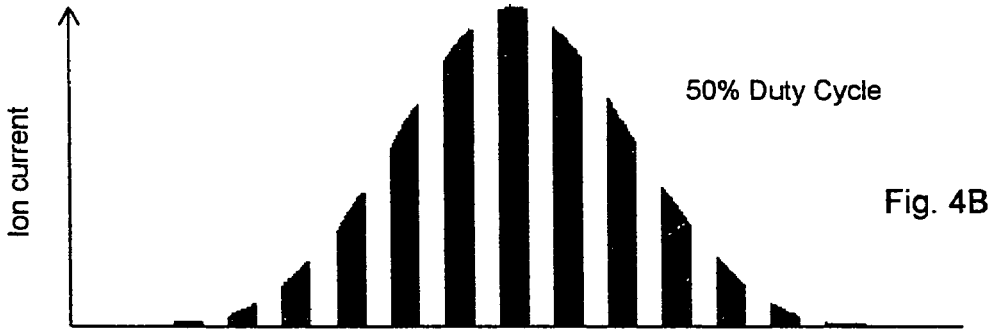
Figure 4C:
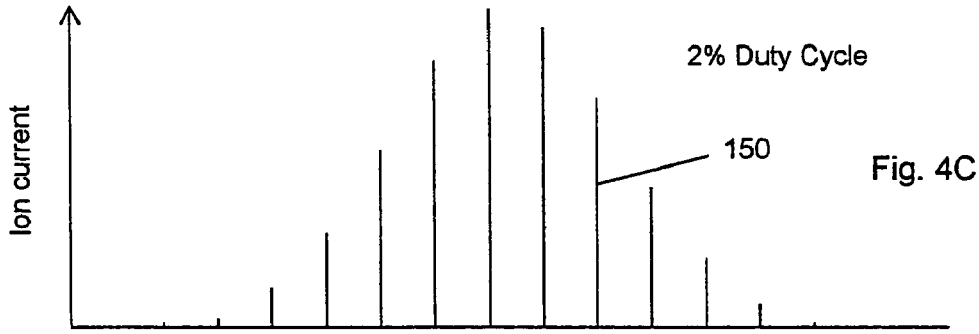

FIGS. 4A-4C illustrate hypothetical ion currents as a function of time (and illustrating the ion current across only a single mass peak) as they would appear to the detection system if there were no peak broadening effects. FIGS. 4A, 4B and 4C represent a 100%, 50%, and 2% duty cycle of the emission current, respectively. The detection electronics and/or processing firmware or software starts with an initial data scan (or makes a real time measurement during mass analysis) and then selects an appropriate duty cycle based on a pre-selected target current or current limit. The detection electronics and/or processing firmware or software filters the data and reconstructs a normalized mass peak based on the filtered data and the duty cycle according to the relationship $$S_N=[S_D*CF_{DC}]/DC$$

where $S_N$ is the normalized signal, $S_D$ is the detected, filtered signal, DC is the duty cycle and CF is a calibration factor (a function of duty cycle), if required.

Figure 4D:
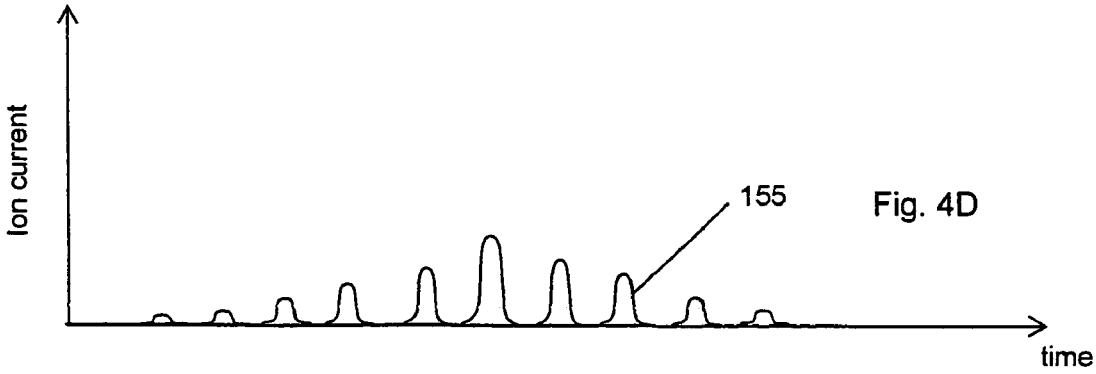
FIG. 4D is a graph illustrating a hypothetical ion current as a function of time at a particular mass peak, utilizing a low duty cycle as in 4C and taking into account defocusing effects on ion populations such as space charge repulsion, kinetic energy spread, and the response time characteristics of the detector.

FIG. 4D illustrates a hypothetical ion current as a function of time (and illustrating the ion current across only a single mass peak) as it would appear to the detection system, taking into account the defocusing effects on ion populations such as space charge repulsion and kinetic energy spread, and also the response time characteristics of the detector. This graph illustrates the attenuation effect on the amplitude of narrow (low duty cycle) ion currents while maintaining peak area. This effect, along with a reduction of the total ion current by virtue of low duty cycle, prevents premature saturation of the detection system, thereby extending dynamic range. Extension of dynamic range may also occur do to a reduction of charge buildup on ion source optics, and the increased ability of these charges to dissipate during the "off" time of the filament.

In brief, particularly at low duty cycles (e.g., at 2%), these effects can cause the ions to spread out, thus changing the sharp spikes 150 into broader peaks 155 of lower amplitude. Assuming that the detector 106 has a maximum dynamic range (e.g., a saturation point), by decreasing the duty cycle, the ion current from a high concentration sample can be brought within the dynamic range of the detector (e.g., below the saturation point), thus dramatically increasing the dynamic range of the device. In addition, the spreading does not appreciably affect mass determination, because the broader peaks 155 track the overall shape of the ion current at 100% duty cycle, and thus the centroid of the mass peak can still be calculated.

Figure 5:
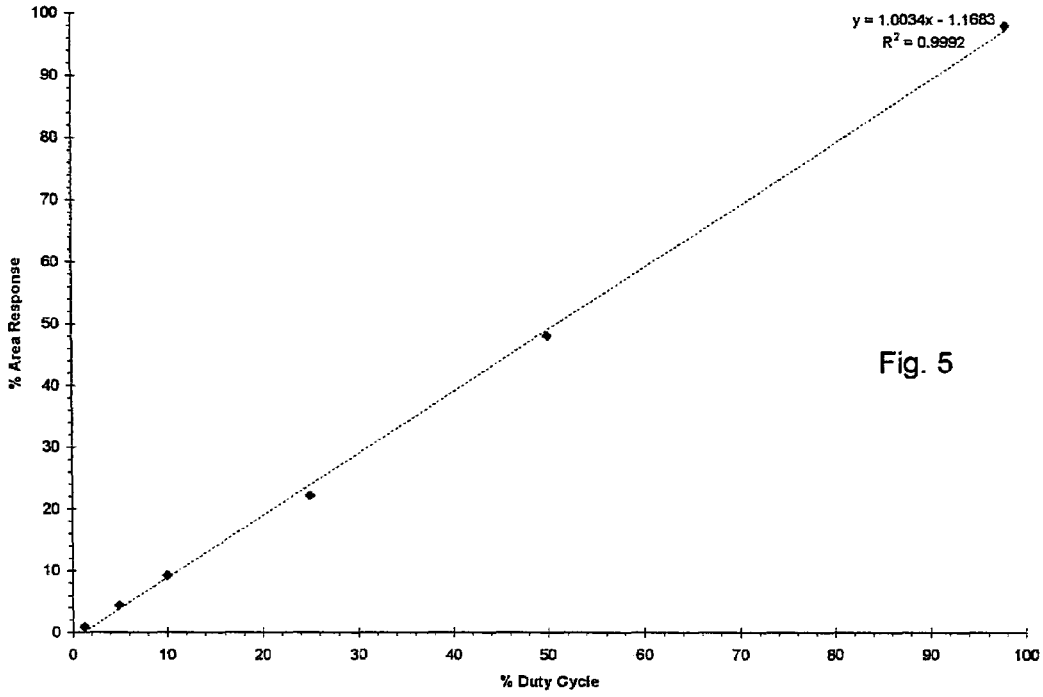
FIG. 5 is a graph illustrating ion current as a function of duty cycle for a perfluorotributylamine sample metered into the ion source at a constant rate.

FIG. 5 shows the normalized detector response (effectively, a normalized ion current) obtained at various duty cycles for perfluorotributylamine metered in at approximately 40 ng/s. Small deviations in the slope or intercept could easily be corrected through a calibration routine which meters in a fixed level of calibration compound, measures the response at various duty cycles and applies a correction factor.

Figure 6:
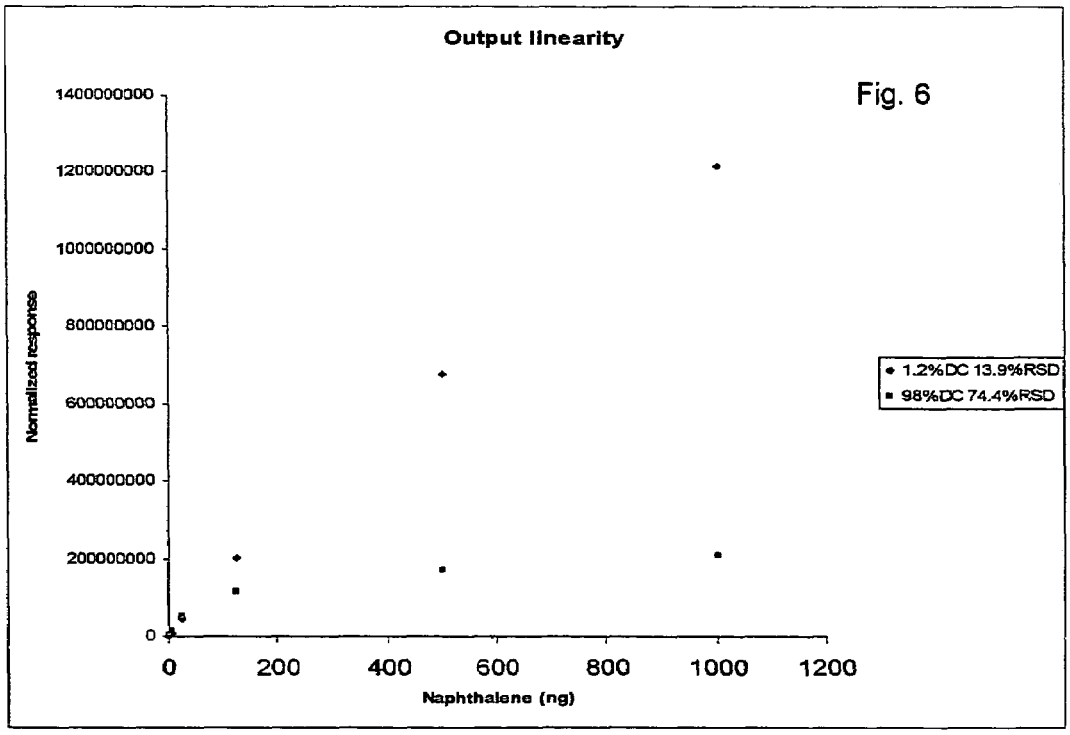
FIG. 6 is a graph illustrating a normalized detector response as a function of sample size for two different duty cycles, for a naphthalene sample. This graph illustrates the extension of dynamic range afforded by reducing the duty cycle.

FIG. 6 shows the non-linear upper portion of a calibration curve for naphthalene acquired at near 100% duty cycle and the improved dynamic range afforded by changing the duty cycle to 1.2%. As can be seen in the data, improvements in dynamic range of at least 100× can be realized.

The controller 120 can be programmed with a variety of procedures to adjust the duty cycle. The duty cycle can follow a preset path, or it can be subject to dynamic control.

In addition, the duty cycle could be determined based on a mixture of a preset pattern and dynamic control. In this way, a gradual change in duty cycle during a scan which occurs in all scans can be imposed to adjust the instrument tune (for example, ion ratios), while a superimposed duty cycle can be used for purposes of preventing ion saturation. Thus, the controller can be programmed to follow a preset duty cycle based on previously acquired scans, or to adjust the duty cycle in a real time fashion as ions of a particular mass to charge ratio are detected. Since the effective duty cycle can be varied by utilizing a fixed frequency and varying the pulse width, or by utilizing a fixed pulse width and varying the frequency, both of these methods may be used concurrently in order to accomplish different objectives. For example, changes in the number of on-off pulses delivered per Da (the pulse frequency) may be altered to prevent ion saturation, while the width of said pulses (the pulse width) may be altered to adjust ion ratios. Control in this way may offer advantages. For example, tuning relative abundances of ions generally requires only a modest level of duty cycle adjustment. If it is desired to have a 2 fold variability in ion production for the purpose adjusting ion ratios, a minimum pulse width of 100 ns extending to a maximum pulse width of 200 ns could be used. This would allow pulsing up to 5 MHz. At most scan rates and ion abundances, this would provide far more cycles/Da than the 10 cycles/Da or so required for good peak definition. This may reduce the amount of filtering required to smooth out the pulses in the data. Additionally, a wide range of scan rates could be used without the need to change the pulse frequency since except at very fast scan rates there will be at least 10 cycles/Da. An additional advantage to using large numbers of narrow pulses per Da is that it gives a finer degree of time resolution when changing duty cycles between mass peaks. If previous scan data is used to calculate duty cycles for the masses in subsequent scans, it is desirable to precisely control the moment at which the duty cycle is changed, such that it occurs in the valley separating ions. The flight times of ions and the differences in flight times of low mass ions versus high mass ions introduces a slight delay from the moment a duty cycle is set versus when it is observed at the detector. These times can be easily calculated however and more precisely set for a given duty cycle when large numbers of narrow pulses are used.

Effectively one can use the duty cycle variation parameters to optimize the instantaneous effect and combined effects that the waveforms have on specific components of a system and the system as a whole.

Figure 7A:
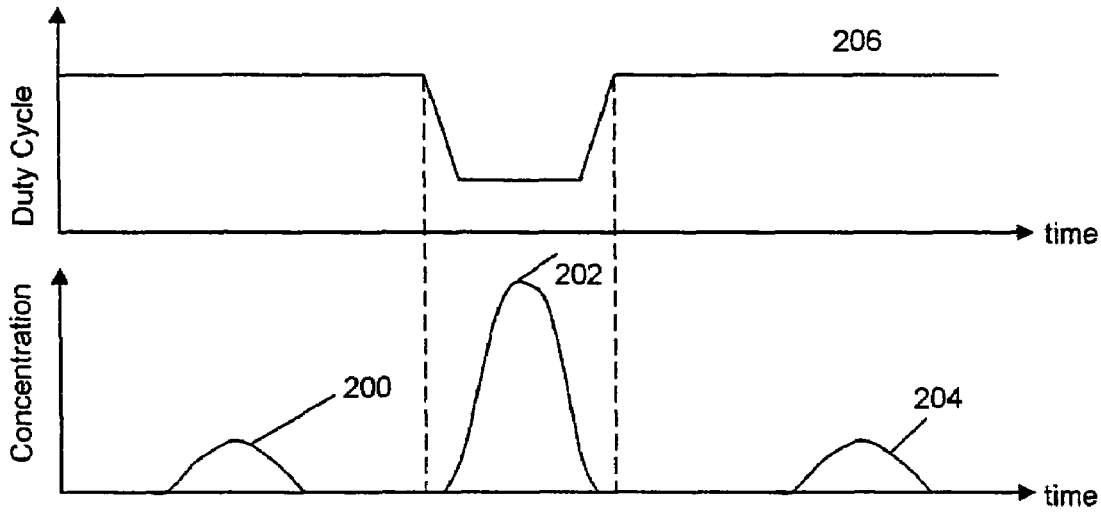
FIG. 7A is a graph illustrating a potential duty cycle to be applied during the elution of a large chromatographic peak.

In a preset path, the controller varies the duty cycle to follow a preprogrammed pattern as a function of time that was determined experimentally or calculated theoretically. An example of a situation in which the controller would vary the duty cycle to follow a preprogrammed pattern is where a sample includes known extraneous compounds in high concentrations. Following activation of a gas chromatograph, different compounds are typically transferred from the gas chromatograph to the ion source at different but reliable times. These times can be determined experimentally. For example, a hypothetical graph of compound concentration as a function of time is shown in FIG. 7A. Each of the peaks 200, 202, 204 can represent a different compound emerging from that gas chromatograph. If the operator knows that the compound represented by peak 202 is present in large quantity (e.g., the operator is attempting to identify trace compounds 200 and 204 in a mixture with 202), then the operator can provide this information to the controller, and the controller will reduce the duty cycle (represented by line 206) during the time that compound 202 is being fed into the ion source. Additionally, the instrument may report the attenuation factor and/or the corrected instrument detection limits in the final data report.

Figure 7B:
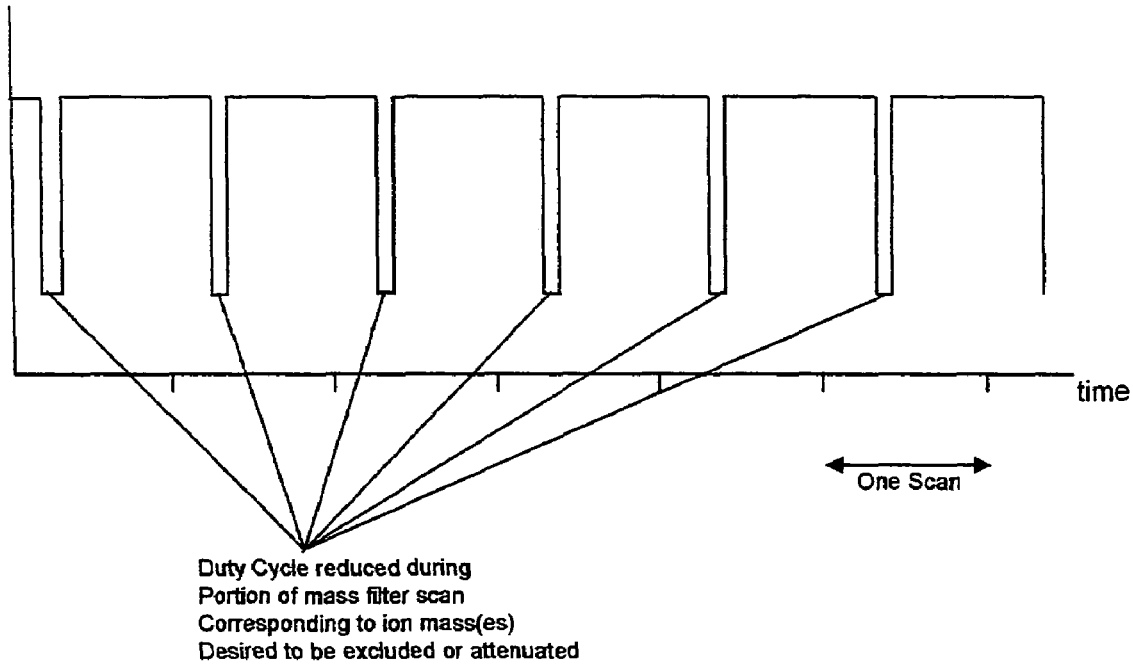
FIG. 7B is a graph illustrating duty cycle as a function of time during multiple scans in which the duty cycle is reduced for a subset of masses during each scan.

In another preset mode, the controller can be configured to exclude or dilute ions of a particular mass. As noted above, information regarding the voltage source 130, such as the frequency and DC offset of the scan signal, can be directed to the controller 120. This permits the controller 120 to effectively make changes in the duty cycle based on the mass being scanned by the quadrupole mass filter. Thus, the duty cycle can be reduced during the portion of each scan during which the excluded mass would otherwise be detected. This permits the operator to exclude specific masses that are not of interest. FIG. 7B shows a hypothetical graph of duty cycle as a function of time for this mode. In an alternative to this mode, the duty cycle can held low for a majority of each scan, and increased for specific masses of interest to the operator.

Figure 8:
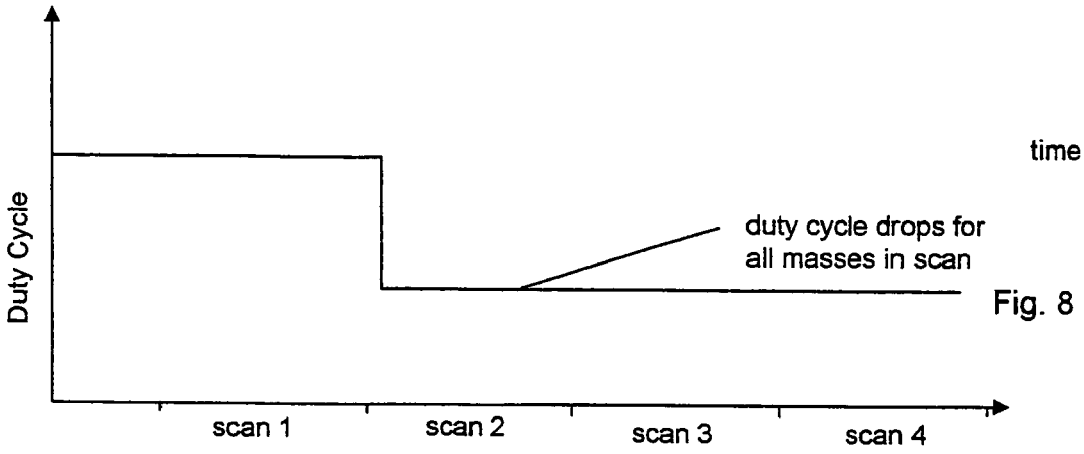
FIG. 8 is a graph illustrating duty cycle as a function of time for multiple scans in which the duty cycle is reduced for all masses covered by each scan.

In dynamic control, the controller receives the ion current signal from the detector 106, and adjusts the duty cycle in real time based on the ion current signal. With respect to ion population control, the controller could operate in two primary modes. In the first mode, the controller determines the total ion current from all masses being scanned from one or more previous scans. If the total ion current exceeds a threshold, the duty cycle can be reduced across the entire scan, effectively throttling back on the production of ions of all masses. This provides for high cleanliness, although it can reduce sensitivity of the system. FIG. 8 shows a hypothetical graph of duty cycle as a function of time for this mode, under the assumption that data from the first scan by the mass filter is used to determine whether the ion current will exceed a threshold.

Figure 9:
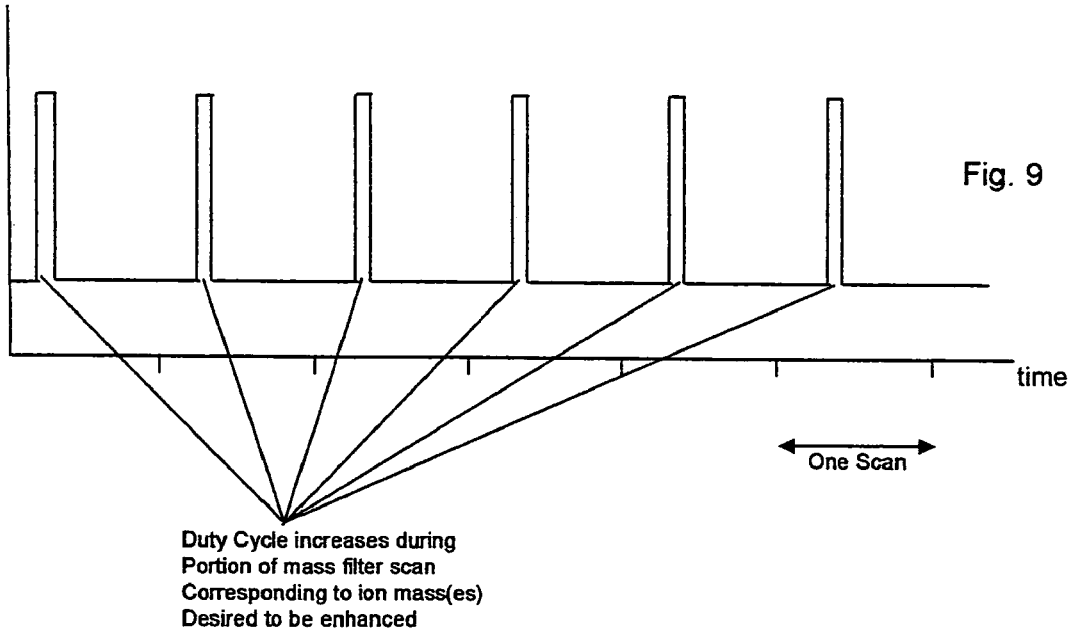
FIG. 9 is a graph illustrating duty cycle as a function of time during multiple scans in which the duty cycle is increased for a subset of masses during each scan.

In the second mode, the controller determines the ion current for each specific ion mass. If the ion current for that mass surpasses a threshold, the duty cycle can be reduced for that specific mass, thus reducing the population of ions of that mass. This second mode maintains the sensitivity of the system to other masses, but does not have the degree of cleanliness of the first mode. In an alternative to this second mode, the duty cycle is held low for majority of each scan, thus providing for high cleanliness with high abundances of matrix ions or other ions outside the window of interest being prevented from polluting the system. The duty cycle is increased for specific masses thus increasing the sensitivity of the system during these specific windows of interest. Moreover, the window can be different from scan to scan. FIG. 7B and FIG. 9 show hypothetical graphs of duty cycle as a function of time for the two alternatives in this mode, under the assumption that data from the first scan by the mass filter is used to determine whether the ion current will exceed a threshold.

The invention is not limited to only these two modes of operation, other modes may be utilized, including for example, a "matrix rejection" mode. In this mode, no ions are allowed over a specific abundance other than ions generated by targeted analyte ions. The duty cycle can be reduced across the range outside the targeted analyte ions effectively throttling back on the production of large abundances of ions that have been formed from matrix. In this manner, ion source and analyzer components can experience far less exposure to ion fluxes which would otherwise degrade instrument performance. In the event that an unknown analyte is utilized, one can vary the duty cycle such that the production of ions formed from matrix is reduced, thereby enhancing the detection of the unknown analyte. In an alternative mode of operation, the duty cycle can be varied simultaneously with respect to an internal standard and a target analyte ion, thereby enabling quantitation of the targeted analyte ions to be performed based on the intensity of the signal acquired for the internal standard mass.

If the duty cycle is varied at selected times during a chromatographic run, the sensitivity of the system is further enhanced.

In addition to the above, mixed or combined modes of operation can be employed, for example both the history provided from a previous scan along with the determination of the ion current for a specific ion mass or range of ion masses can be utilized to provide ion population control. In one such mode of operation, the controller can apply a waveform with a variable duty cycle during each scan to the instrument. For example, during the first part of each scan, the duty cycle can be set at 10%, during a second part of the same scan the duty cycle can be set at 20%, and so on until a 100% duty cycle has been reached at the end of the scan. In this manner, one can increase high mass sensitivity with respect to low, essentially tuning the instrument. If one were in addition to this, to superimpose a waveform such that the duty cycle was varied in a manner such that specific matrix ions were attenuated in every scan, the duty cycle additionally being varied during the period of a chromatographic run, one could have specific ions increased or decreased on a scan by scan basis, and the sensitivity of the instrument tuned to specific needs.

Figure 10A:
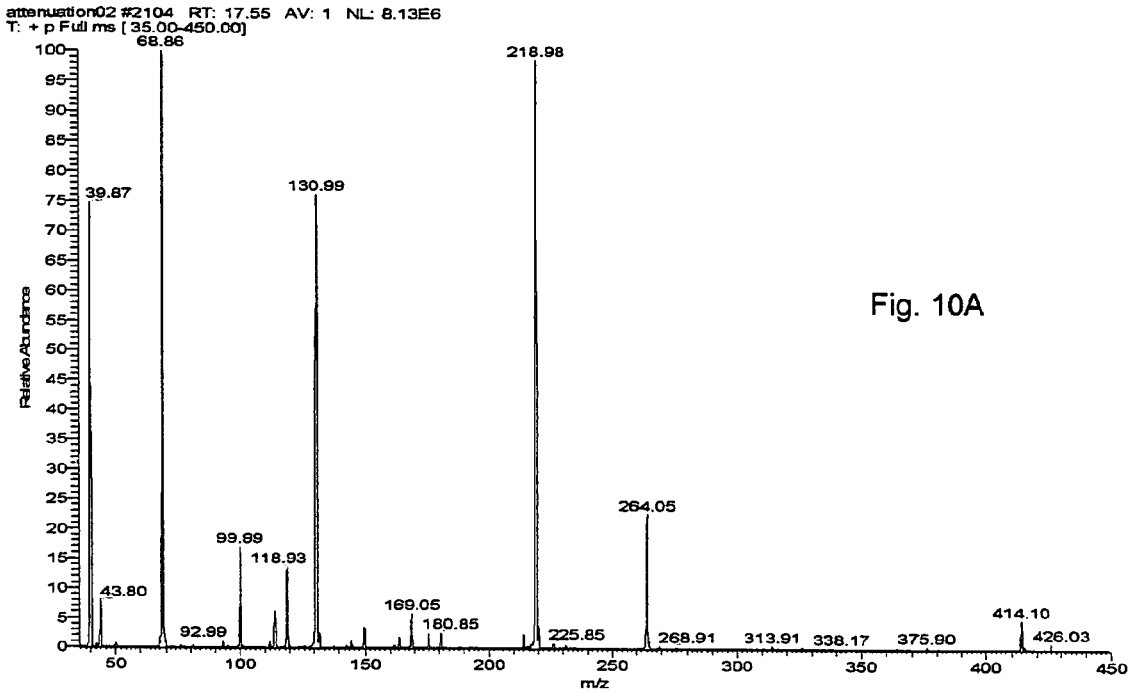
FIG. 10A is an output of a mass spectrometer without using the invention for a perfluorotributylamine sample.
Figure 10B:
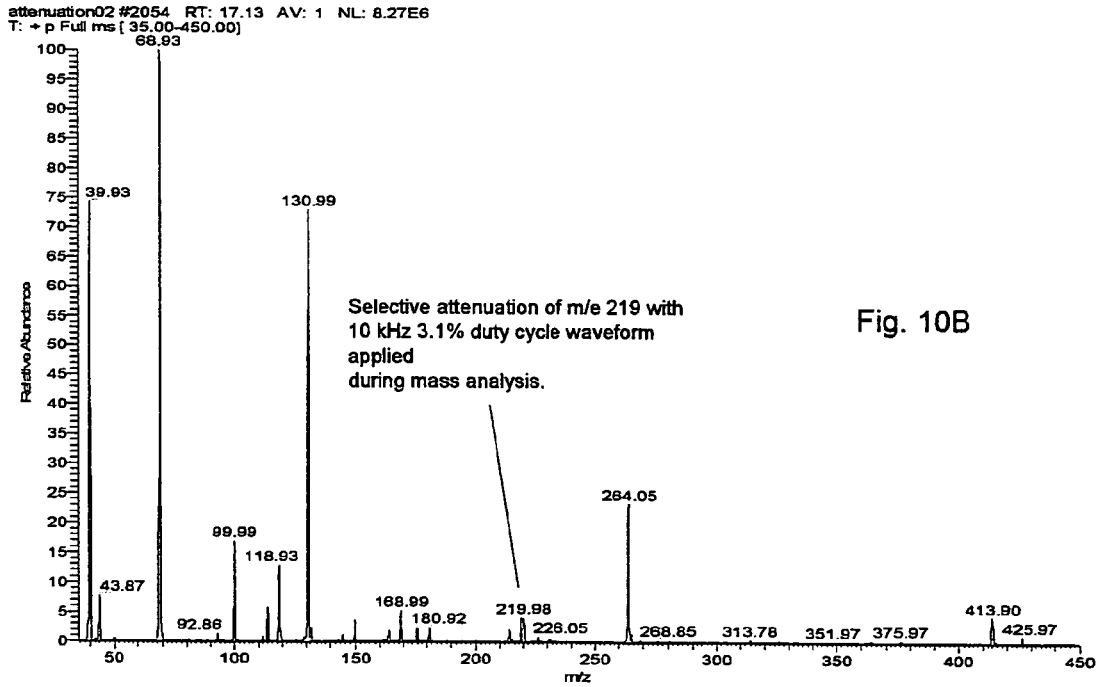
FIG. 10B is an output of a mass spectrometer using the invention to create selective attenuation of m/e 219 for a perfluorotributylamine sample.

FIGS. 10A and 10B show the selective attenuation of m/e 219 of perfluorotributylamine to the level of its isotope peak at m/e 220 by applying an appropriate duty cycle during mass analysis.

Yet another advantage of this invention over the prior art is the ability to modulate the duty cycle along with the complete mass scan. Since the time based approach to ionization is linear and predictable, a modulated duty cycle during the scan can be used to alter instrument tuning (i.e. adjusting ion intensity ratios) in a predictable way. Traditionally, tuning of a quadrupole device for example, has been accomplished by varying lens potentials, ion energies or otherwise which do not have linear predictable results and conversely, several attempts to affect an adequate instrument tune may ensue.

Yet another advantage of this invention over the prior art is to allow attenuation of specific high intensity ions without dilution of lower intensity ions. This retains analyte detection limits.

Yet another advantage of this invention over the prior art quadrupole devices is improved electron multiplier lifetime. Since the lifetime of these devices is largely a function of total extracted charge, limitation of the ion current offers increased lifetime.

Yet another advantage of this invention over the prior art is the potential to achieve lower detection limits without sacrificing dynamic range. Since the current to the multiplier is limited, this allows the detector to be operated at a higher gain for a given lifetime.

Although the above descriptions have been confined to quadrupole and ion trap systems, other analyzer forms can be utilized and benefit from this invention. One such system is a TOF (Time-of-Flight) system. In this example, gating the filament can set the optimum total ion flux reaching the detector.

Figure 11:
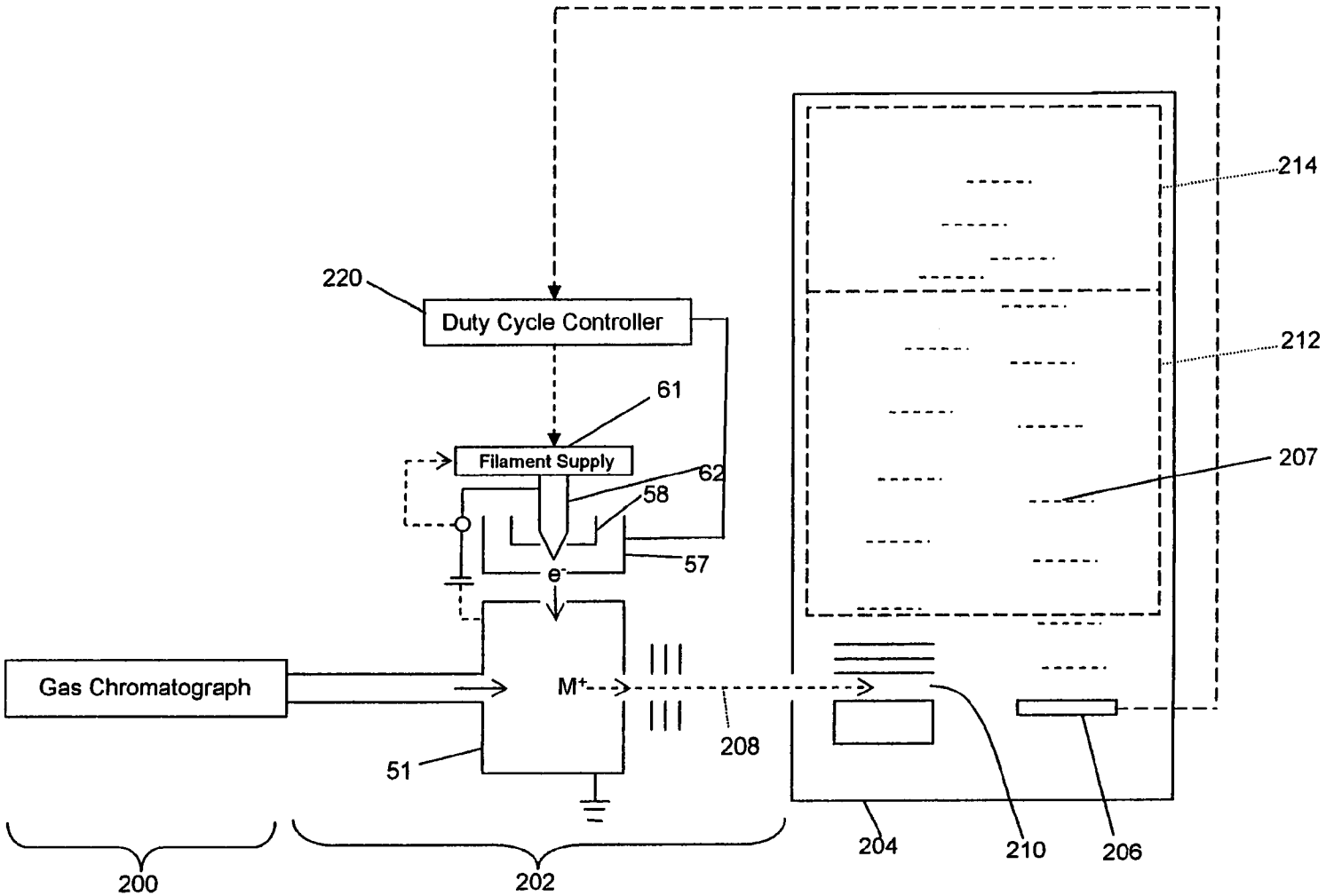
FIG. 11 is a schematic illustration of an implementation of a time of flight mass spectrometer constructed according to the present invention.

Referring to FIG. 11, an exemplary time-of-flight mass spectrometer includes a source 200, such as a gas chromatograph, of sample particles, such as atoms or molecules, an ion source 202 to ionize the sample molecules, and a time-of-flight mass analyzer 204 that includes a detector assembly 206. The ion source 202 can be constructed as described with respect to FIG. 3A, with a filament 62 powered by a filament supply 61 to generate electrons which pass, through a gate 57 controlled by a duty cycle controller 220. While the gate 57 is "open", the electrons pass into an ion volume 51 to collide with sample molecules from the ion source 202, generating a pulsed ion beam 208. The time-of-flight mass analyzer 204 includes a push-out region 210 which pushes a line segment 207 of the pulsed ion beam 208, a drift region 212, an a reflectron 214 to reverse the course of the line segment of ion beam 208 back toward the detector 206.

In a typical orthogonal acceleration time of flight mass spectrometer (oa-ToF), the detector assembly includes one or more time-to-digital converters (time digitizers) and/or flash analog to digital converters for data acquisition. One problem associated with time digitizers is the so-called "dead time" which limits the maximum ion count rate in these devices. In addition, at even higher ion fluxes, the electron multiplier itself will become non-linear in its response. Typically, manufacturers specify maximum linear output currents around 10% of the bias current of the multiplier. However, by using a gated electron beam, the total ion flux to the time digitizers can be reduced in a quantitative fashion, thereby extending the dynamic range of the ToF instrument. The dynamic range of analog to digital converters as well as electron multipliers can also be effectively increased by acquiring spectra at varying duty cycles.

Another potential advantage is that by increasing the dynamic range of the detector assembly, the detector assembly can be constructed without secondary anodes, thereby reducing cross-talk, response drift and mass discrimination.

For example, an oa-ToF with an initial ion energy of 40 eV will fill a 2 cm push out region in as little as 1.3 microseconds for mass 35 or as long as 7.2 microseconds for mass 1000. If the electron gate is pulsed at a frequency of 1 MHz with a pulse width of 100 nanoseconds, this will result in a 10% duty cycle in ion production with ample time available to ensure the pulse is applied during the interval of time when m/e 35 is traversing the push out region. A typical mode of operation would be to histogram several spectral shots at 100% duty cycle followed by several spectral shots at 10% duty cycle for dynamic range extension. If the detector anode is used as the input to a time digitizer as well as a flash A/D converter, two channels of detector data with two levels of duty cycle each would then be available to reconstruct the data.

Another system is a QTOF (quadrupole—Time-of-Flight) mass spectrometer. In this example, the quadrupole can be used to filter the ions before allowing them to enter the TOF. This essentially provides automatic gain control (AGC) for TOFs where an optimal ion abundance for any mass can be obtained. A variable duty cycle could be applied to the electron gate. The duty cycle would be adjusted to control the number of ions formed so that the desired number of ions of a particular mass pass from the mass filter into the TOF. Alternatively, in combination, or instead, a variable duty cycle could be applied to an ion gate to control the number of ions of a particular mass that pass into the TOF. This ion gate could include a gate lens before or after the mass filter as described above. Or, the ion gate could be the mass filter itself by adjusting say the offset voltage applied to the mass filter to prevent ions from reaching the TOF. More generally, this approach can be applied to any other hybrid type analyzer where the combination of an ion source and any mass filter is used to filter ions before introduction into the subsequent analysis stage. Thus, a system constructed and operated according to the present invention can provide increased dynamic range, robustness and tunability.

One embodiment of the invention consists of a quadrupole mass spectrometer having an ion source with a gated electron beam which is cycled on and off at a frequency which is great enough to provide adequate mass centroiding and peak profiling while at the same time low enough to allow the widest range in adjustable duty cycle. Typical quadrupoles require 5-15 points per Dalton. For example, a typical quadrupole instrument, requiring 10 points per Dalton for proper peak definition, scanning at 1000 Daltons per second, would require a 10 kHz pulse rate. If the minimum gate "on" time were limited electrically due to slew rate, heat rejection of components etc. to 100 nanoseconds, this would result in a duty cycle variability of 1000×. (100 ns to 100 us in adjustable "on" time).

Figure 1:
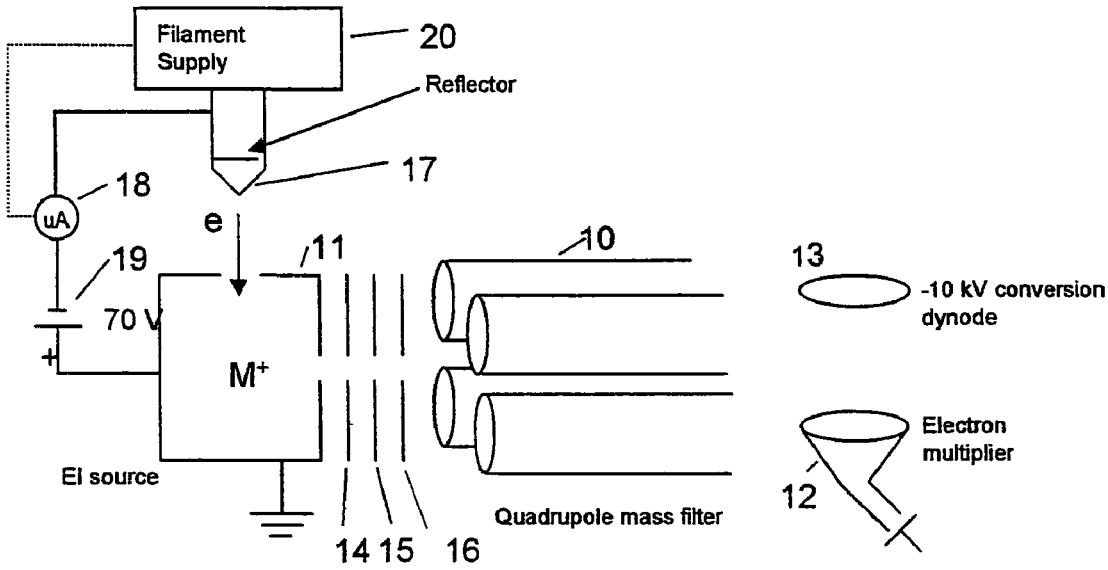
PRIOR ART Fig. 1
FIG. 1 is a schematic illustration of a prior art quadrupole mass spectrometer.
Figure 2:
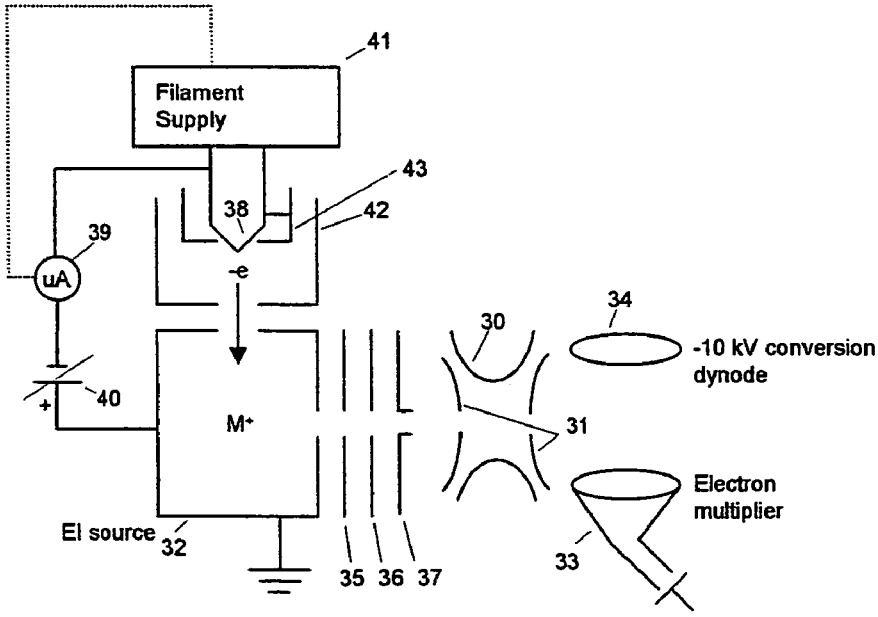
PRIOR ART Fig. 2
FIG. 2 is a schematic illustration of a prior art ion trap mass spectrometer.

In another embodiment, electron gating can be used with an ion trap mass spectrometer. To reduce space charge effects, the total number of ions in the ion trap must be regulated. This is done with automatic gain control (AGC). Usually a lens such as 35, 36, or 37 in FIG. 2 is used to adjust the number of ions allowed to enter the ion trap. Alternatively, electron gating could be used to primarily control the number of ions in the ion trap. In other words, no ion gate would be used. The ion population in the ion trap would be adjusted by adjusting the length of time and/or duty cycle of the filament. This may have the advantage of turning on and off the ion beam more quickly than can be done with an ion gate.

An electron gate could be combined with an ion gate. The ion gate is effective in quantitatively adjusting the number of ions sent to the ion trap when the time it is open is relatively long compared to the flight time of ions through it. When the ion gate must be opened for a very short period of time because of a high ion flux, the ion gate may not be quantitative. Also, large voltages may be required to gate ions which make the amplifiers that drive the ion gate expensive. Alternatively, a longer ion gate time could be used while gating electrons to reduce the number of ions formed. In other words, the ion gate would be opened before electrons were admitted into the ion volume. Then, electrons would be gated to form ions in the ion volume. The duty cycle would be adjusted to send the necessary number of ions to the ion trap. Then, the electron gate would be closed and then the ion gate would be closed. This would allow fewer ions to be sent to the ion trap in a quantitative manner than with the ion gate alone. This would also allow for a slower slew rate for the ion gate resulting in lower cost electronics.

This example shows that this invention can be used with a non beam mass spectrometer like an ion trap. The invention could also be used with a TOF, orbitrap, or other mass spectrometers. A non beam mass spectrometer would not allow adjustment of ion intensity on a mass-to-mass basis. However, the ion source and instrument would be kept clean by using a lower duty cycle for the filament.

A number of embodiments of the invention have been described. Nevertheless, it will be understood that various modifications may be made without departing from the spirit and scope of the invention. Accordingly, other embodiments are within the scope of the following claims.

What is claimed is:

1. A continuous beam mass spectrometer for providing mass analysis comprising:

an ion volume to receive atoms or molecules of a sample;

an electron source to inject electrons into the ion volume to ionize the atoms or molecules in the ion volume;

a mass filter to receive ions from the ion volume, the mass filter having a mass scanning rate; and an electron gate for gating electrons at a frequency equal to or greater than the mass scanning rate and having a variable duty cycle, the electron gate configured to provide ion abundance control for any given mass during mass analysis.

2. The mass spectrometer of claim 1, wherein the electron source includes a filament and a voltage source for applying a voltage to the filament.

3. The mass spectrometer of claim 1, wherein the voltage with respect to the source is sufficient to accelerate the electrons to an energy sufficient to ionize atoms and molecules.

4. The mass spectrometer of claim 1, wherein the electron gate is variable between a plurality of different fixed duty cycles.

5. The mass spectrometer of claim 1, wherein the electron gate has a continuously variable duty cycle.

6. The mass spectrometer of claim 5, wherein the duty cycle of the electron gate is adjustable from 0-100% duty cycle.

7. The mass spectrometer of claim 1, wherein the electron gate has a frequency greater than 1 cycle per Dalton scanned by the mass filter.

8. The mass spectrometer of claim 1, wherein the duty cycle of the electron gate is varied throughout a mass filter scan.

9. The mass spectrometer of claim 1, wherein the duty cycle of the electron gate is varied between adjacent ion masses.

10. The mass spectrometer of claim 1, wherein atoms and molecules are ionized directly.

11. The mass spectrometer of claim 1, wherein the electrons ionize reagent gas molecules or atoms to form ions which in turn ionize the sample molecules or atoms.

12. The mass spectrometer of claim 1, wherein the duty cycle of the electron gate is adjusted based on the previous scan.

13. The mass spectrometer of claim 12, wherein the duty cycle of the electron gate is adjusted based on a total ion current from a previous scan.

14. The mass spectrometer of claim 12, wherein the duty cycle of the electron gate is adjusted based on ion currents associated with specific masses of a previous scan.

15. The mass spectrometer of claim 1, wherein the duty cycle of the electron gate is adjusted during the scan based on ion current feedback within the same scan.

16. The mass spectrometer of claim 1, further comprising an ion extractor to transfer the ionized atoms and molecules from the ion volume to the mass filter.

17. The mass spectrometer of claim 1, wherein the electron gate is the electron source.

18. The mass spectrometer of claim 1, wherein the electron gate is separate from the electron source and controls a flow of electrons from the electron source to the ion volume.

19. The mass spectrometer of claim 1, further comprising a detector, and wherein a first duty cycle variation parameter is selected to prevent the detector from ion saturation, and a second duty cycle variation parameter is selected to effect tuning of the mass spectrometer.

20. A continuous beam mass spectrometer for providing mass analysis comprising:

an ion volume to receive atoms or molecules of a sample;

an electron source for injecting electrons into the ion volume to ionize the atoms or molecules in the ion volume;

a mass filter having a mass scanning rate; and an ion extractor to transfer the ionized atoms and molecules from the ion volume to the mass filter, wherein the ion extractor includes a gate which gates ions at a frequency equal to or greater than the mass scanning rate and having a variable duty cycle, the gate configured to provide ion abundance control for any given mass during mass analysis.

21. A method of operating a continuous beam mass spectrometer for providing mass analysis, the mass spectrometer having an ion volume to receive atoms or molecules of a sample, an electron source to inject electrons into the ion volume to ionize the atoms or molecules in the ion volume, a mass filter to receive ions from the ion volume and having a mass scanning rate, and an electron gate with a variable duty cycle for gating the electrons, the method comprising the steps of:

gating the electrons at a frequency equal to or greater than the mass scanning rate; and providing ion abundance control for any given mass during mass analysis.

22. The method of claim 21, wherein the step of gating the electrons includes varying the duty cycle of the electron gate.

23. The method of claim 22, wherein the duty cycle is varied to control the number of ions in the ion volume.

24. The method of claim 22, wherein the duty cycle is varied to effect tuning of the mass spectrometer.

25. The method of claim 22, wherein the duty cycle is varied such that a first duty cycle variation parameter is selected to control the number of ions in the ion volume and a second duty cycle variation parameter is selected to effect tuning of the mass spectrometer.

26. The method of claim 22, wherein the duty cycle is varied between a plurality of different duty cycles.

27. The method of claim 22, wherein the duty cycle is varied continuously.

28. The method of claim 21, wherein the step of gating the electrons includes adjusting the duty cycle during a scan of the mass filter.

29. The method of claim 21, wherein the step of gating the electrons includes adjusting the duty cycle of the electron gate based on a previous scan of the mass filter.

30. The method of claim 29, wherein the step of gating the electrons includes adjusting the duty cycle based on a total ion current from a previous scan of the mass filter.

31. The method of claim 29, wherein the step of gating the electrons includes adjusting the duty cycle based on ion currents associated with specific masses of a previous scan of the mass filter.

32. The method of claim 21, wherein the step of gating the electrons includes adjusting the duty cycle based on ion current feedback with the same scan.

33. A method of operating a continuous beam mass spectrometer for providing mass analysis, the mass spectrometer having an ion volume to receive atoms or molecules of a sample, an electron source to inject electrons into the ion volume to ionize the atoms or molecules in the ion volume, a mass filter having a mass scanning rate, and an ion extractor to transfer the ionized atoms and molecules from the ion volume to the mass filter; the method comprising the steps of:

gating the ions at a rate equal to or greater than the mass scanning rate; and providing ion abundance control for any given mass during mass analysis.

* * * * *